US006340323B1

(12) United States Patent
Glynn

(10) Patent No.: US 6,340,323 B1
(45) Date of Patent: Jan. 22, 2002

(54) WATERSLIDE TOY BLOCK CONSTRUCTION SYSTEM

(75) Inventor: Kenneth P. Glynn, Raritan Township Hunterdon Valley County, NJ (US)

(73) Assignee: Ideal Ideas, Inc., Flemington, NJ (US)

( * ) Notice: Subject to any disclaimer, the term of this patent is extended or adjusted under 35 U.S.C. 154(b) by 0 days.

(21) Appl. No.: 09/645,137

(22) Filed: Aug. 24, 2000

(51) Int. Cl.[7] ..... A63H 33/08

(52) U.S. Cl. ..... 446/89; 40/406; 40/412; 446/128; 446/168; 446/176

(58) Field of Search ..... 40/406, 412, 422; 434/126, 299; 446/89, 120, 128, 166, 167, 168, 176, 267

(56) References Cited

U.S. PATENT DOCUMENTS

| | | | | |
|---|---|---|---|---|
| 3,005,282 A | | 10/1961 | Christensen | |
| 3,751,827 A | * | 8/1973 | Gaskin | |
| 3,752,472 A | | 8/1973 | Snead | |
| 4,413,436 A | * | 11/1983 | Ward et al. | |
| 4,744,780 A | | 5/1988 | Volpe | |
| 4,778,430 A | * | 10/1988 | Goldfarb et al. | 446/167 |
| 5,074,437 A | | 12/1991 | D'Andrade et al. | |
| 5,112,263 A | * | 5/1992 | Penillard et al. | 446/89 |
| 5,150,819 A | | 9/1992 | Johnson et al. | |
| 5,277,585 A | * | 1/1994 | Aminighazvini | 434/126 |
| 5,344,143 A | | 9/1994 | Yule | |
| D353,851 S | | 12/1994 | Glynn | |
| 5,480,336 A | | 1/1996 | Blanchard | |
| 5,944,575 A | * | 8/1999 | Tolnay | 446/168 |
| 5,971,764 A | * | 10/1999 | Todd | 434/126 |
| 6,149,991 A | * | 11/2000 | Okuda | |
| 6,176,027 B1 | * | 1/2001 | Blount | 40/406 |

* cited by examiner

*Primary Examiner*—John A. Ricci
(74) *Attorney, Agent, or Firm*—Kenneth P. Glynn; Deirdra M. Meagher

(57) ABSTRACT

The present invention is a waterslide toy block construction system. The present invention includes a plurality of toy construction blocks that can be arranged to create a variety of multi-block structures. Some of the construction blocks have a plurality of elongated projections extending from said top surface, and the undersurface of such blocks defines recesses therein for frictionally engaging the elongated projections of other such blocks. Other construction blocks have conduits for water flow (hereinafter groves) which can be assembled to create continuous, extendable and generally horizontal and vertical paths for the travel of water thereon. The top surface of such blocks defines at least one groove thereon for the routing of water. When a user correctly arranges the blocks to form a multi-block structure, these grooves form a path thereon for the travel of water throughout such a multi-block structure. In this embodiment, there is also a construction block unit having mechanism for connecting a water outlet, such as a hose or a tank. The connection mechanism incorporates and adapter to reduce water pressure and to prevent detachment of the water outlet due to hydrodynamic motion therethrough.

18 Claims, 22 Drawing Sheets

2
3
4
5
6
8
9
14
16
17
19
20
21
22
23
24
25
29
31
71
72
73

WATERSLIDE TOY BLOCK CONSTRUCTION SYSTEM

BACKGROUND OF THE INVENTION

1. Field of the Invention

The present invention is directed to a waterslide toy block construction system, and more particularly, to toy construction blocks with grooves which can be assembled to create continuous, extendable and generally horizontal and vertical paths for the travel of water thereon.

2. Information Disclosure Statement

Toy construction blocks have been manufactured and successfully marketed for generations. They have been designed to connect to one another, to connect to tubes and rods, and even to connect to toy figurines of people, animals, vehicles, and other objects. Of particular popularity have been construction blocks with pegs and the accessories that combine with them, for example, the type sold under the trademark LEGO, the type sold under the trademark DUPLO, and the type sold under the trademark PLAYMOBIL.

Games and toys which employ water as a basic amusement factor have also been around for years. Among the popular devices are water guns, water slides, water sprinklers, and water-related hoop toys.

The following U.S. patents and other literature represent items related to the present invention and represent the state-of-the-art in this field:

U.S. Pat. No. 3,005,282 to Christiansen teaches a toy building brick which includes a plurality of pegs protruding from the top surface of each brick and a plurality of recesses along the undersurface of each brick sized and shaped so as to engage such pegs for clamping bricks together in a fashion determined by the user. Both the pegs and the recesses may have differently shaped cross-sections, and the brick itself has a friction post located at its midsection to facilitate the attachment of other such bricks.

U.S. Pat. No. 3,752,472 to Snead teaches a child's building toy which comprises elongated, tubular building units with connectors at each end. The units are hollow to facilitate travel of water therethrough, and some of the units have apertures which allow water to spray. The units have bends in them which allow the user to create various structures.

U.S. Pat. No. 4,744,780 to Volpe shows an adapter block which can be varied to interconnect with a peg block construction toy. The blocks define generally parallel sidewalls that define a plurality of open ends for the receiving of pegs on a peg block construction toy. The adapter block can also be manufactured to slope considerably from the horizontal.

U.S. Pat. No. 5,074,437 to D'Andrade et al. and U.S. Pat. No. 5,150,819 to Johnson et al., both teach water devices that implement self-contained means of pressurizing water with compressed air, creating a pressure differential between the water and the ambient atmosphere.

U.S. Pat. No. 5,344,143 to Yule teaches a marble run game that involves toy construction blocks assembled to create extended paths for travel of at least one marble. The blocks have grooves defined thereon that facilitate rolling marbles, and said grooves can be aligned to create a multiplicity of paths to prolong the balls'run. The construction blocks may have more than one groove, and multiple grooves may intersect.

U.S. Pat. No. 5,480,336 to Blanchard teaches a water construction kit featuring a plurality of elongated tubular elements and mating connectors, which elements and connectors provide for the flow of water therethrough. The connectors may include shutoff valves to provide selective control of water flowing through the individual tubes.

U.S. Pat. No. Des. 353,851 to Glynn is a design for a multi-orificed tubular toy construction block, featuring recesses in each of the block's four sides and an orifice through the block's midsection. The block's orifice and recesses facilitate connection of rods and tubes thereto.

Notwithstanding the prior art, the present invention is neither taught nor rendered obvious thereby.

SUMMARY OF THE INVENTION

The present invention is a waterslide toy block construction system. The present invention includes a plurality of toy construction blocks, said construction blocks having a top surface, a bottom surface and at least three side surfaces. Some of the construction blocks have a plurality of elongated projections extending from said top surface. Each of said blocks also has an undersurface that defines recesses therein for frictionally engaging the elongated projections of other such blocks.

Other construction blocks have conduits for water flow (hereinafter "grooves") which can be assembled to create continuous, extendable and generally horizontal and vertical paths for the travel of water thereon. Each of said blocks has a top surface and a side surface which define at least one groove for the routing of water. When a user correctly arranges the blocks to form a multi-block structure, these grooves form a path for the travel of water thereon, which path can be alternated to suit the user's preference.

There is a construction block unit having means for connecting a water outlet, such as a hose or a tank. The connection means incorporates an adapter to reduce water pressure and to prevent detachment of the water outlet due to hydrodynamic motion therethrough.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
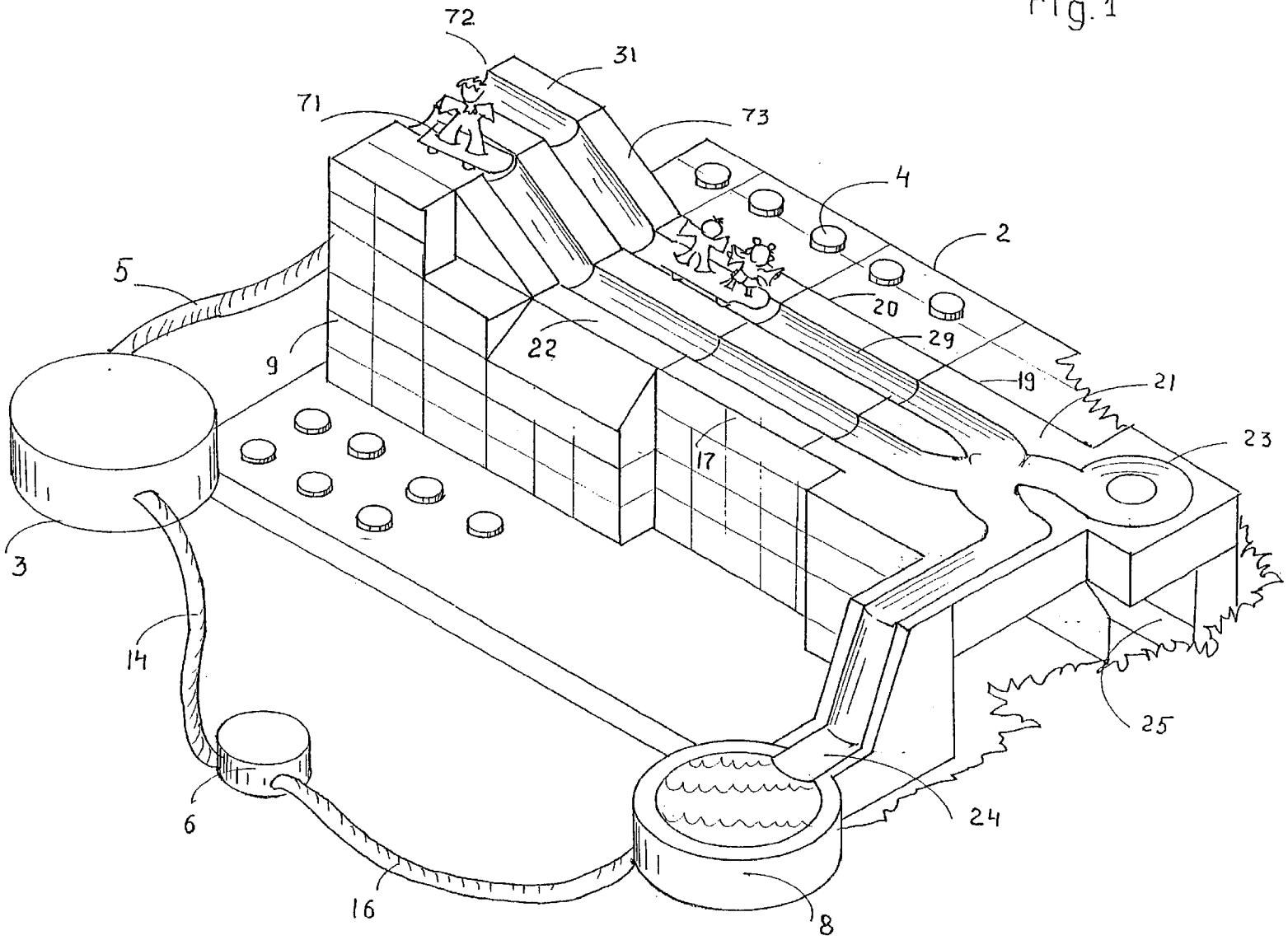
FIG. 1 is a perspective view of a waterslide toy block construction system with an attachment unit for connection to a water source, said water source comprising a water storage reservoir, a pressurized water storage tank, and a pumping means.

The present invention is a waterslide toy block construction system. The present invention includes a plurality of various toy construction blocks, which can be arranged into at least one multi-block structure that defines an extended path for the travel of water thereon. In a preferred embodiment, there is also a construction block unit having means for connecting a water outlet, such as a hose or a tank. The connection means incorporates an adapter to reduce water pressure and prevent detachment of the water outlet due to hydrodynamic motion therethrough. This adaptation can be retrofitted to be used with structures comprised of construction blocks of the type sold under the trademark LEGO, or with construction blocks of another type or source, or with the marble run game disclosed in U.S. Pat. No. 5,344,143 to Yule.

Each of the construction blocks have at least a top, a bottom and three side surfaces. Some blocks are standard blocks which have a plurality of elongated projections from said top surface, an open bottom, and an elongated friction post extending from the undersurface of said top. Some of the blocks also have pre-shaped conduits for water flow (hereinafter "grooves"). When a user correctly arranges the grooved blocks in a multi-block structure, the series of grooves forms a path thereon for the travel of water. Some blocks are ramp blocks, which have a top surface that slopes considerably from the horizontal and which can be manufactured with or without grooves. Some blocks are grooved wedge blocks, having a top surface that is parallel with the bottom surface and at least one side surface that slopes considerably from the vertical. Such a side surface has at least one groove defined thereon.

There may be two grooves on a grooved toy construction block, and these may intersect in a number of ways. There may also be a construction block that defines an opening at the base of a corkscrew groove, and the opening delivers the flowing water to adjacent grooved toy construction blocks or to a base pool.

In an alternative embodiment, water may also circulate through the construction system by electric-powered pumping means attached to a water reservoir such as a base pool, said base pool having an inlet to connect it to a pump for return of the water. In addition, a pressurized water storage tank could be included as an enhancement to the circulation of water. The pump can return water to a pressurized water storage tank, and such tank could operate with a single tank mechanism which is filled partially with water and partially with air and pressurized with a pump mechanism. An electrical power source would be required for such autonomous pumping means. This power source can be either a self-contained battery unit or a solar panel arranged upon a surface of pre-assembled housing for such a power source.

There is a plurality of toy miniatures, each having an undersurface defining a plurality of apertures sized, shaped and spaced so as to frictionally engage the elongated projections of a standard toy construction block. The toy miniatures can be connected to the top surface of the construction blocks so as to build tunnels or bridges, or to assemble objects associated with certain themes, such as palm trees, sailboats and umbrellas to represent an island getaway, or flowers, watering cans and picket fences to represent a gardening scene.

The toy construction blocks can be manufactured from molded plastic or any other suitable material known to be used in the art. The toy miniatures are preferably made of molded plastic, but may be made out of another suitable material used in the art.

Referring now to FIG. 1, a waterslide toy block construction system 1 consists of a plurality of construction blocks 17, 19, 21, 23, 25, 27 and 31, manufactured to be connected and disassembled by the user in a desired arrangement to provide an extended, generally horizontal and vertical path for the flow of water. The waterslide toy block construction system 1 may be used, for example, with toy construction blocks of the type sold under the trademark LEGO, or with other blocks of different type or source, or with a base support structure 2 having elongated projections 4 thereon.

Figure 2:
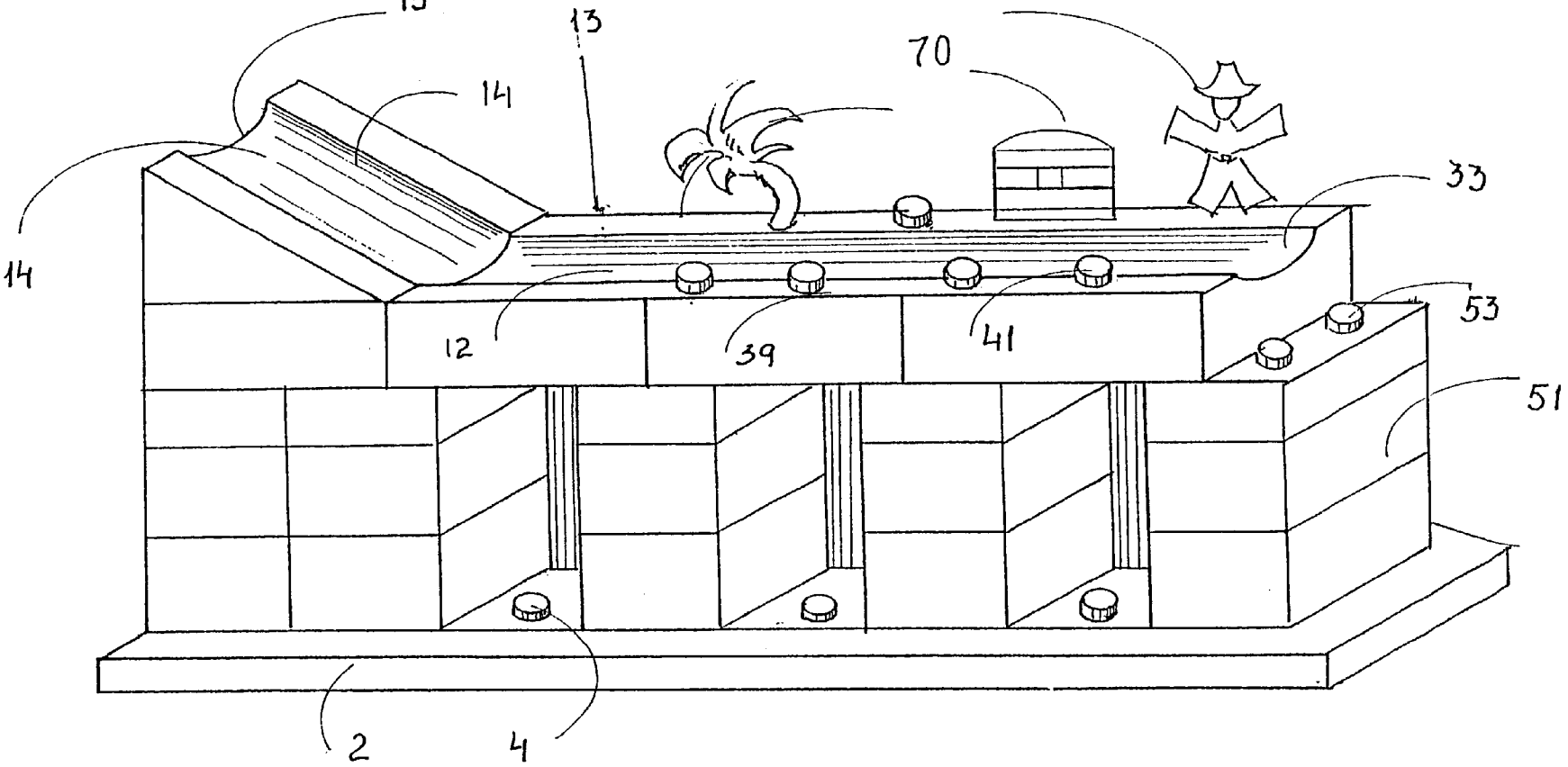
FIG. 2 is a partial perspective view of a waterslide toy block construction system with toy miniatures.

As shown in the accompanying figures, a typical waterslide toy block construction system might include the following: several standard construction blocks 51, each with a plurality of elongated projections 53 (FIG. 2); several construction blocks 19, each with a groove defined upon the top surface to facilitate the flow of water thereon (FIG. 1); several construction blocks 21, 23, 25, 27 and 31 with dual grooves and intersecting grooves defined on the top surface to vary the travel of water thereon (FIG. 1); several grooved toy construction blocks 39 having a plurality of elongated projections 41 (FIG. 2); a pressurized water storage tank 3 connected to pumping means 6 by water return avenue 14 and also connected to attachment means 7 by water return avenue 5 (FIG. 1); a plurality of miniature toy figurines 70 to accessorize a waterslide toy block construction system 1 (FIG. 2); a plurality of assorted toy FIGS. 71, 72 and 73 adapted to travel along the paths generated by a user of a waterslide toy block construction system (FIGS. 1, 46 and 47); and an attachment unit 9 with adapter 7 for connection of a water outlet 5 to a waterslide toy block construction system 1 (FIG. 1).

Figure 3:
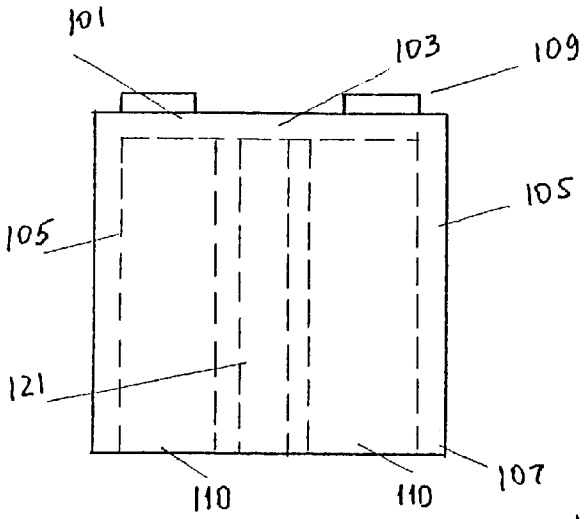
FIGS. 3, 4 and 5 are a side view, a perspective view and a bottom view, respectively, of a standard toy construction block.
Figure 4:
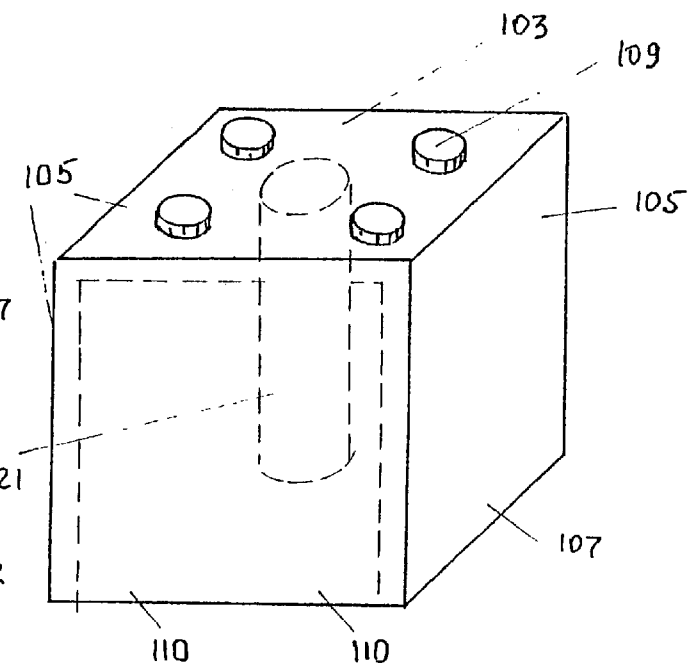
Figure 5:
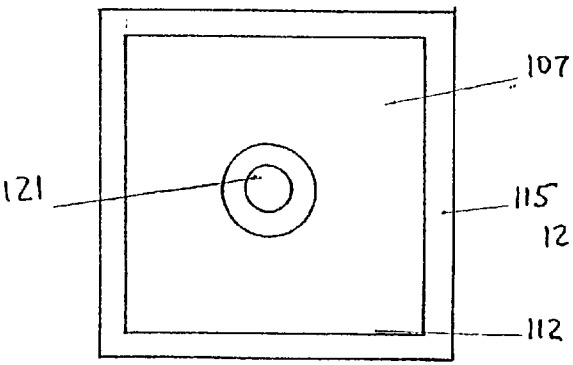

Referring now to FIGS. 3, 4 and 5, a standard toy construction block 101 has a top surface 103, a bottom surface 107 and at least four side surfaces 105. Each block has a plurality of elongated projections 109 extending from said top surface 103. Each block also has at least one elongated friction post 121, being hollow and extending from the undersurface 112 of top 103 for clamping with other such blocks. Undersurface 112 further exposes recesses 110, said recesses being defined by exterior wall 115.

Figure 6:
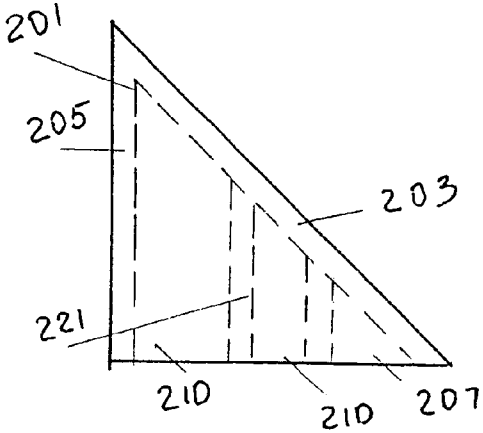
FIGS. 6, 7 and 8 are a side view, a perspective view and a bottom view. respectively, of a ramp block.
Figure 7:
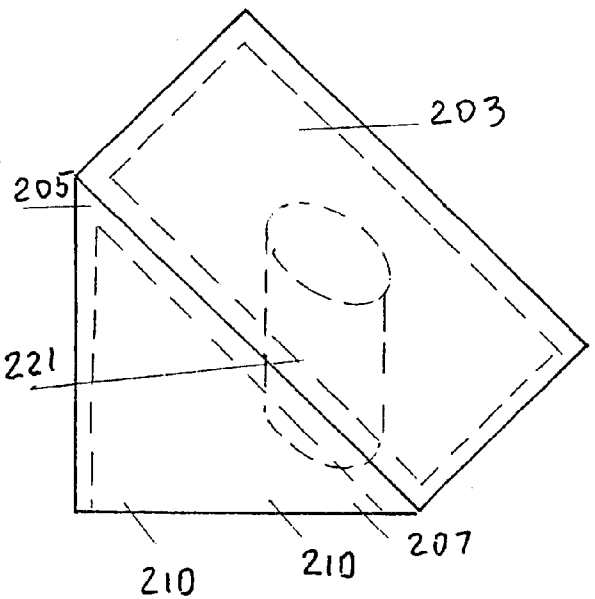
Figure 8:
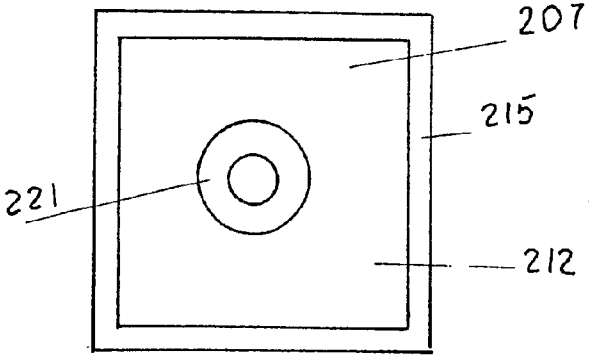

Referring now to FIGS. 6, 7 and 8, a typical ramp block 201 has a top surface 203, a bottom surface 207 and three side surfaces 205. Each block also has at least one elongated friction post 221 extending from undersurface 112 of top 103.

Figure 9:
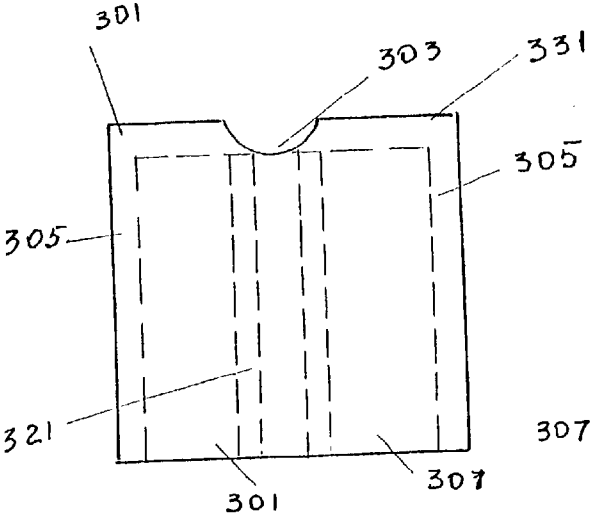
FIGS. 9, 10 and 11 are a side view, a perspective view and a bottom view, respectively, of a grooved toy construction block.
Figure 10:
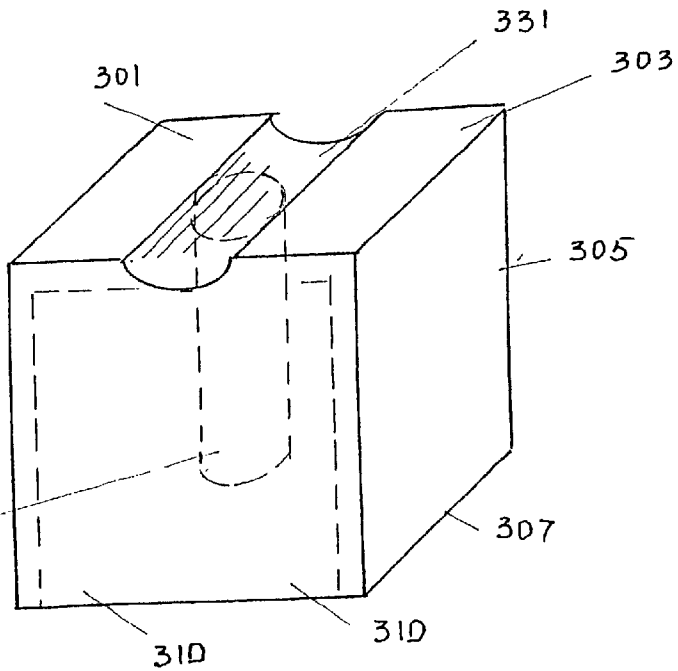
Figure 11:
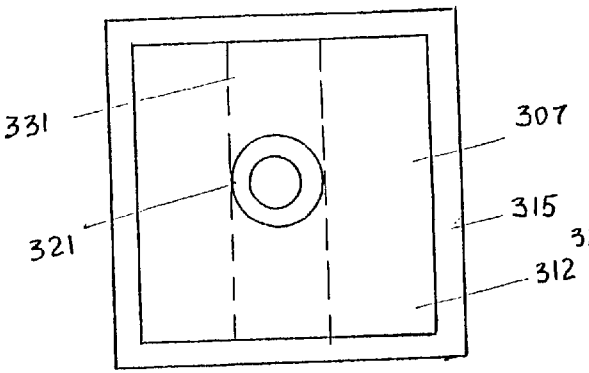
Figures 12, 13, 14:
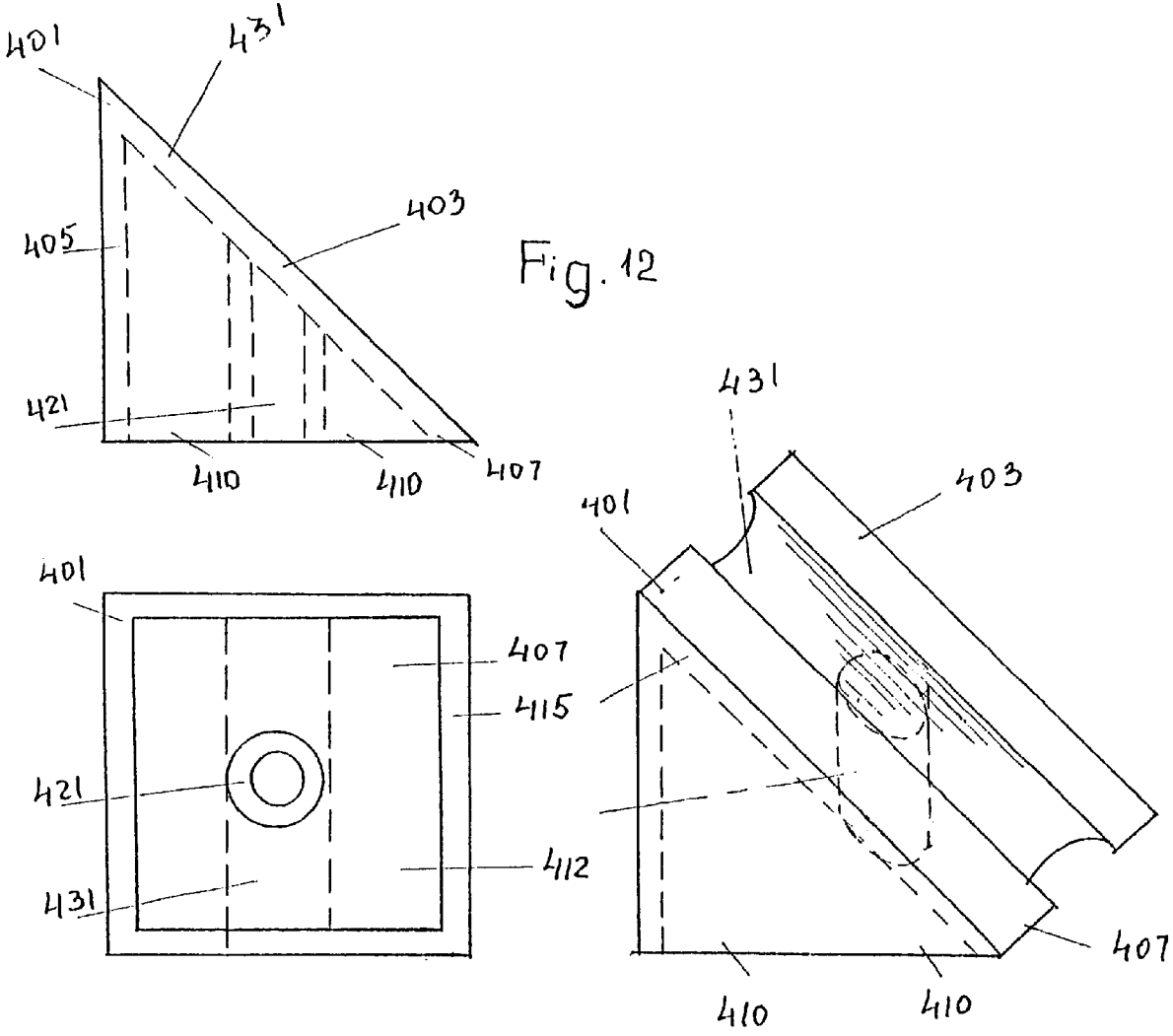
FIGS. 12, 13 and 14 are a side view, a perspective view and a bottom view, respectively, of a grooved ramp block.
Figure 15:
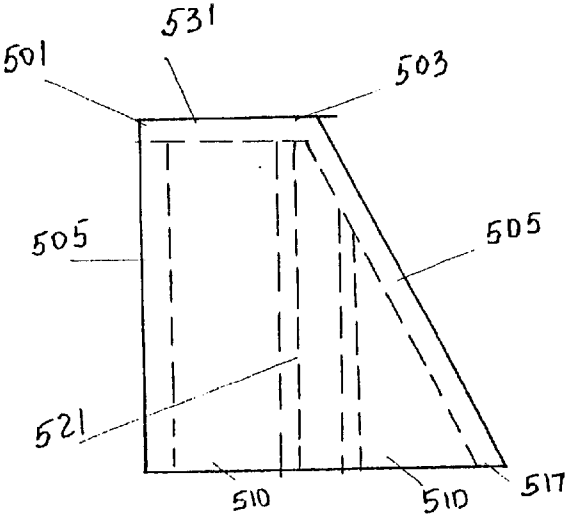
FIGS. 15, 16 and 17 are a side view, a perspective view and a bottom view, respectively, of a grooved wedge block.
Figure 16:
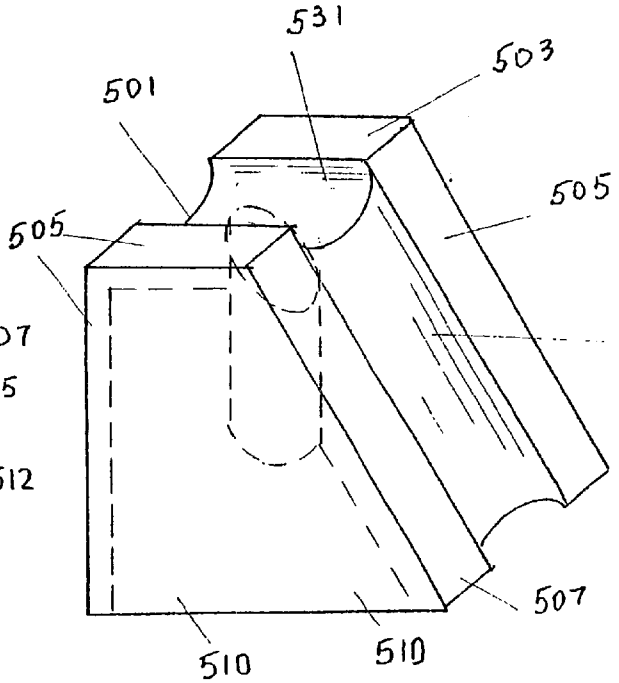
Figure 17:
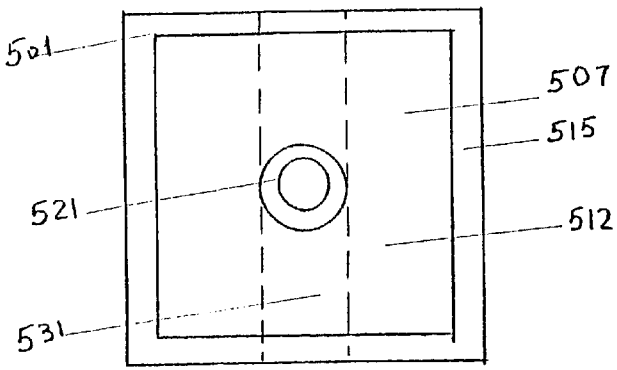
Figure 18:
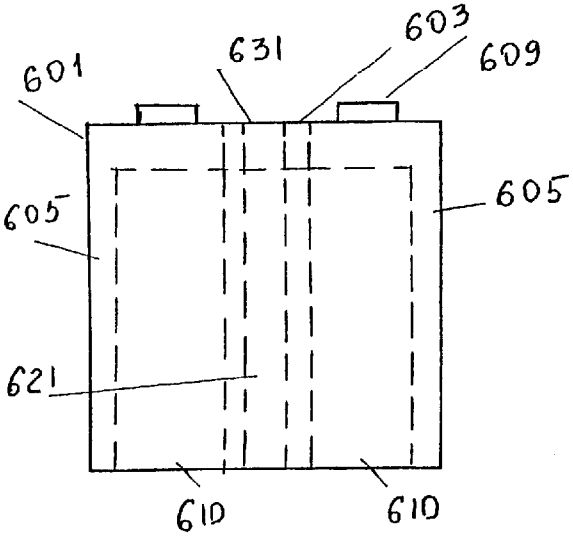
FIGS. 18, 19 and 20 are a side view, a perspective view and a bottom view, respectively, of a grooved toy construction block with a plurality of elongated projections.
Figure 19:
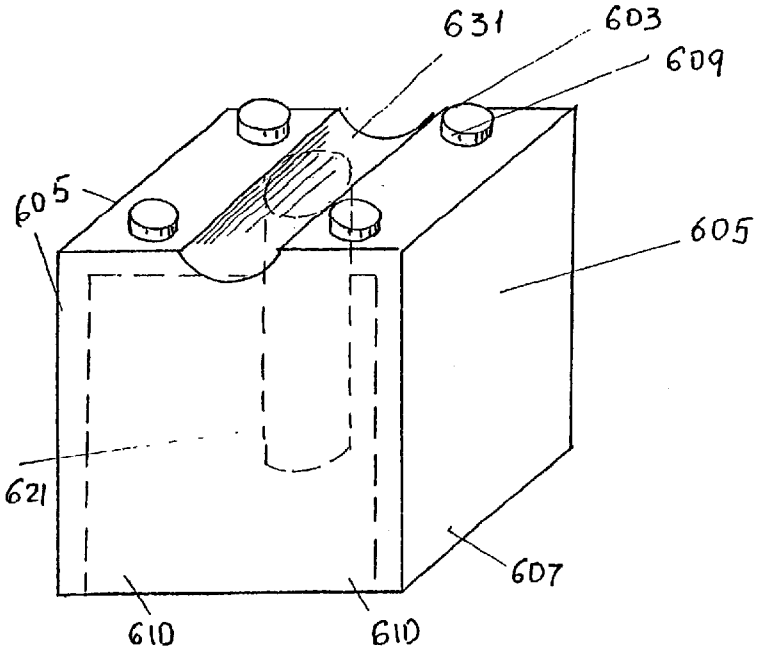
Figure 20:
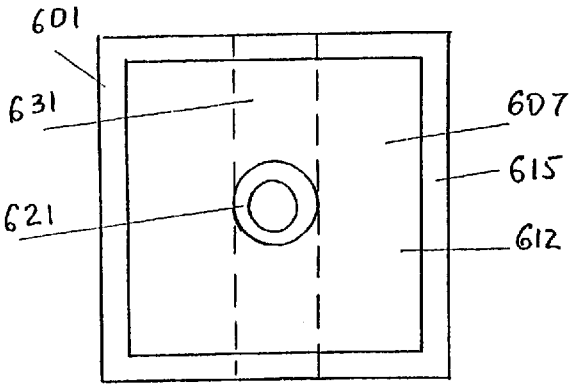
Figures 21, 22, 23:
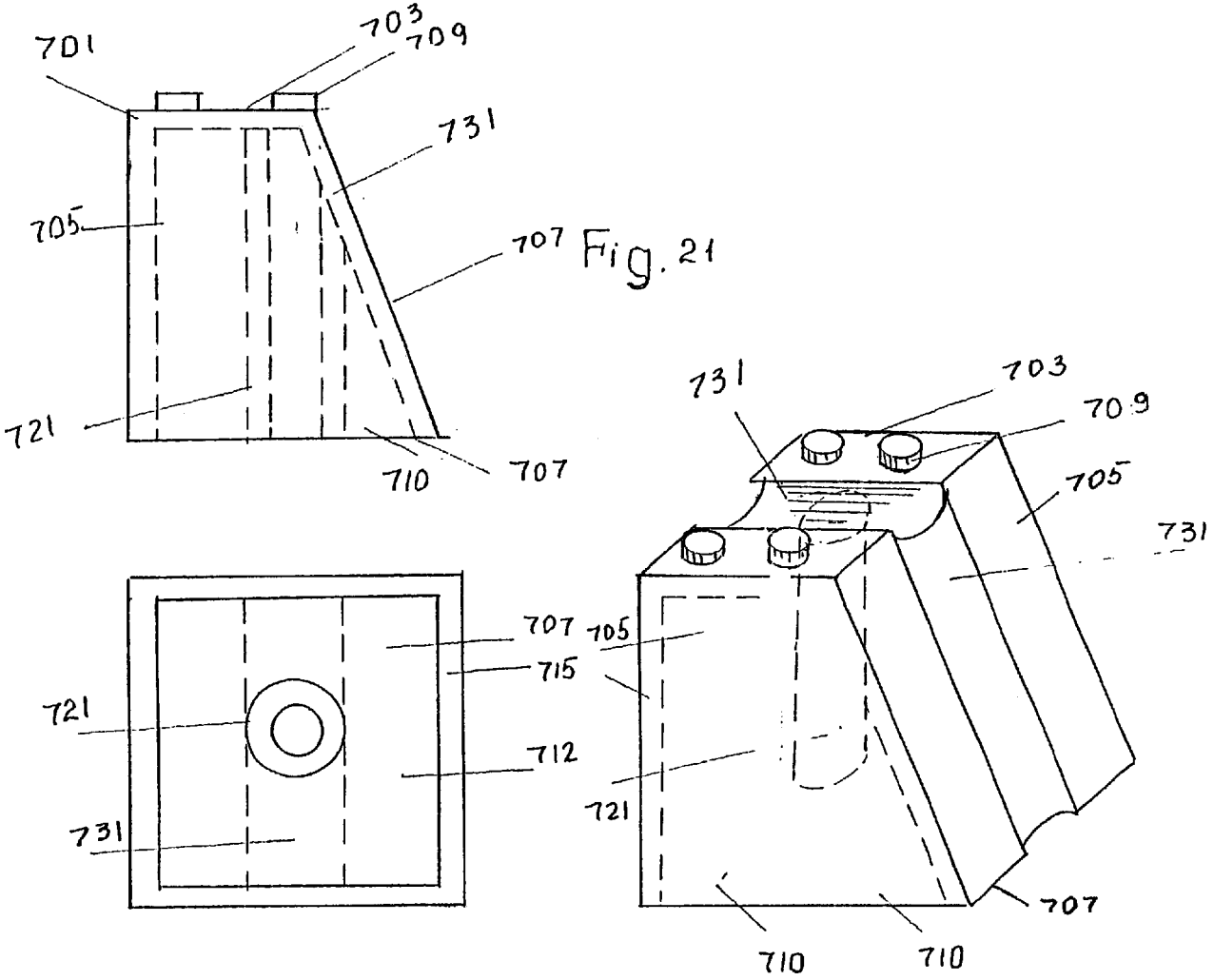
FIGS. 21, 22 and 23 are a side view, a perspective view and a bottom view, respectively, of a grooved wedge block with a plurality of elongated projections.
Figure 25:
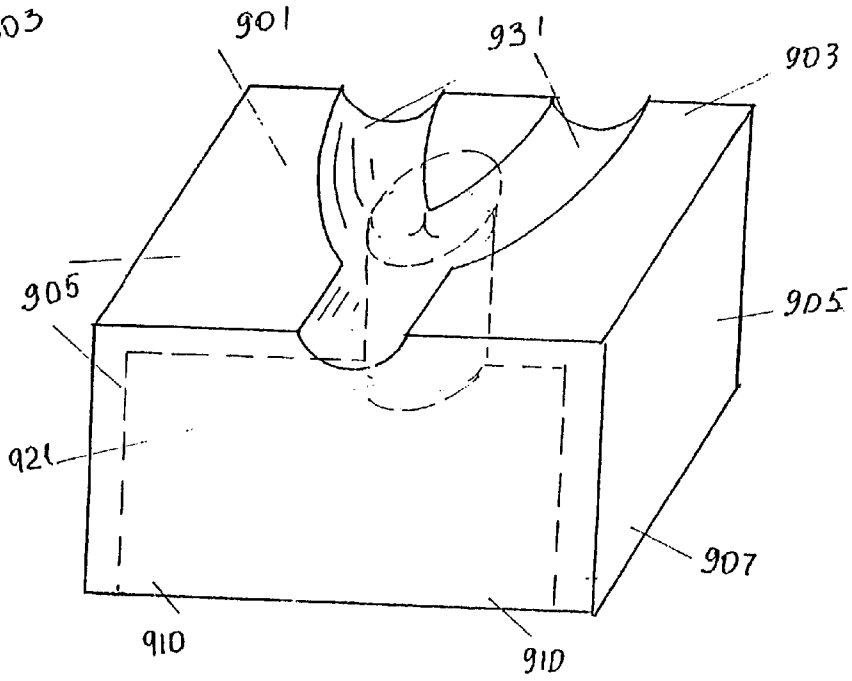
FIG. 25 is a perspective view of a toy construction block with intersecting grooves.
Figure 24:
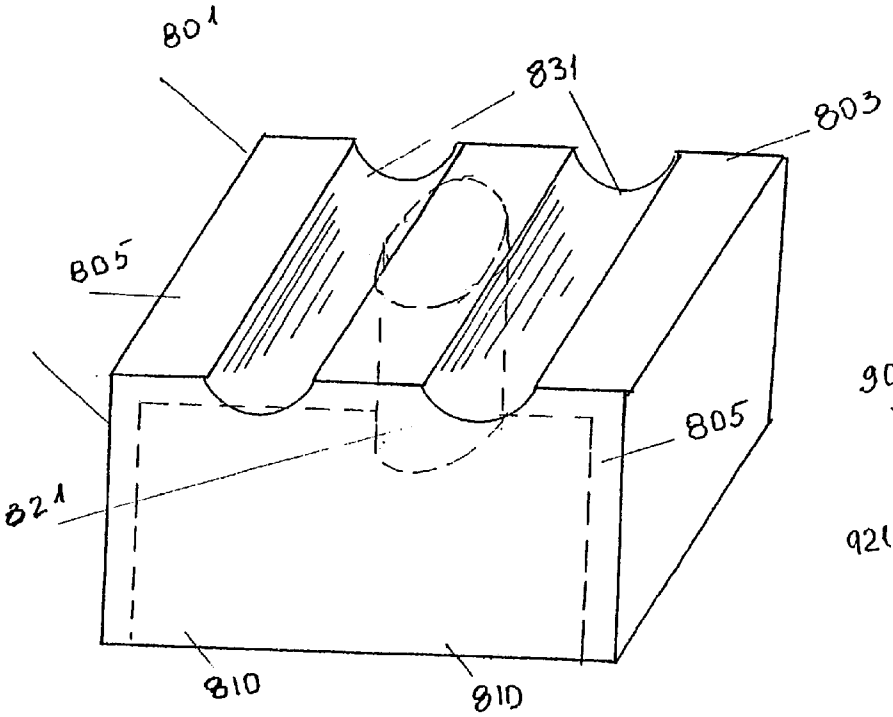
FIG. 24 is a perspective view of a toy construction block with two grooves.
Figure 27:
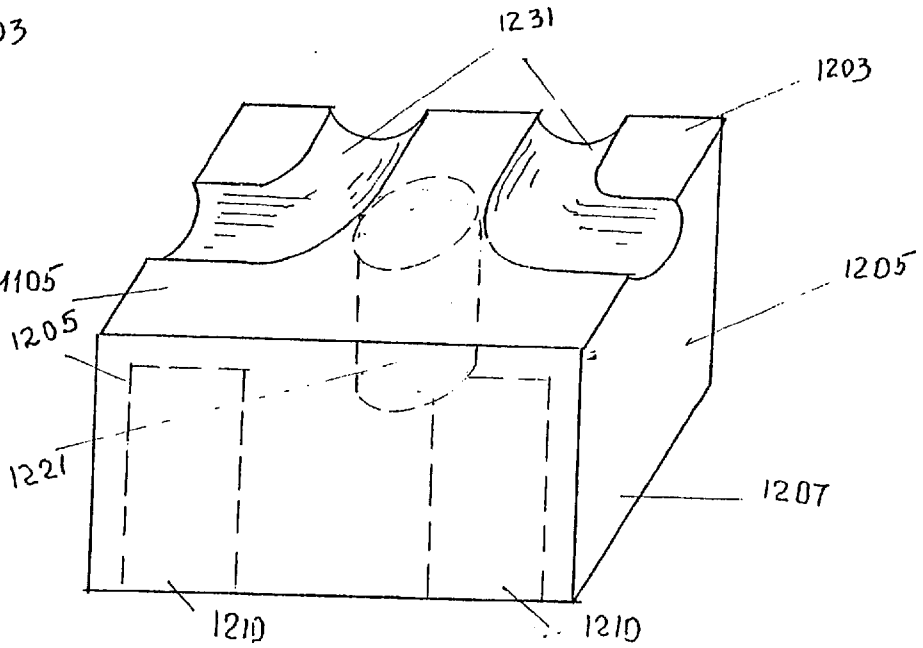
FIG. 27 is a perspective view of an alternative embodiment of a toy construction block with two grooves.
Figure 26:
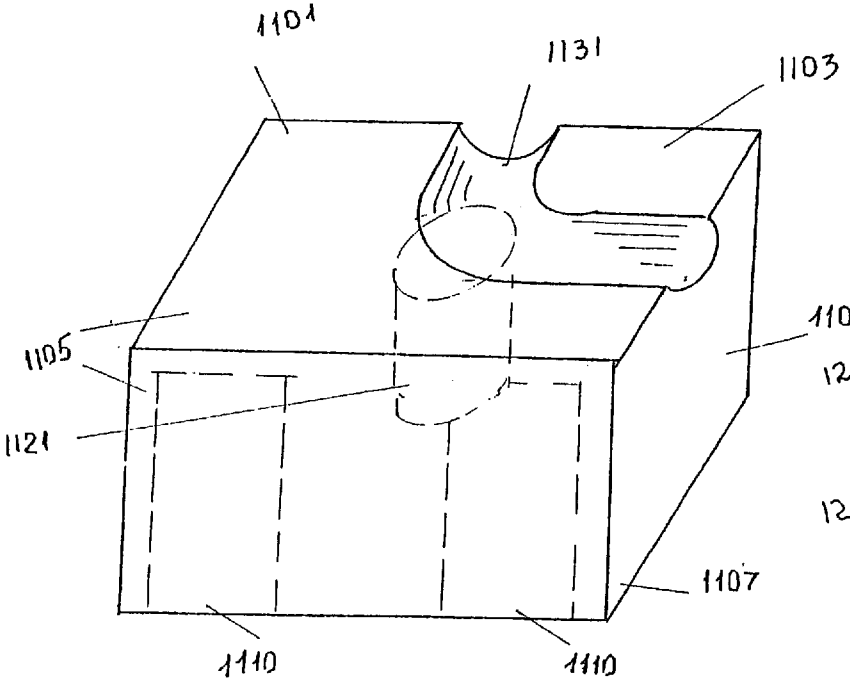
FIG. 26 is a perspective view of an alternative embodiment of a toy construction block with one groove.
Figure 29:
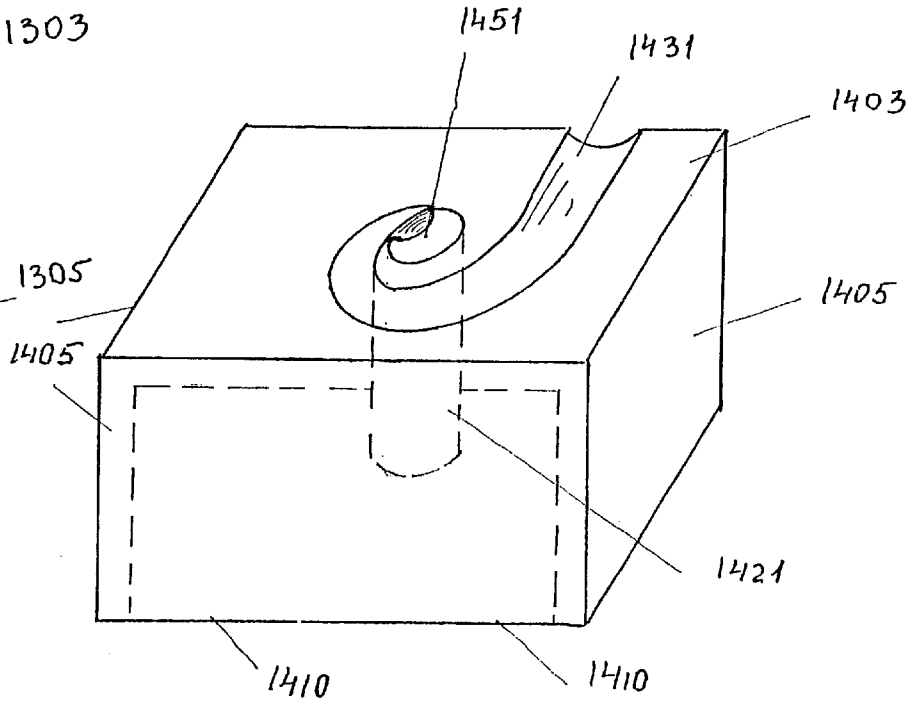
FIG. 29 is a perspective view of a toy construction block with a corkscrew groove and opening.
Figure 28:
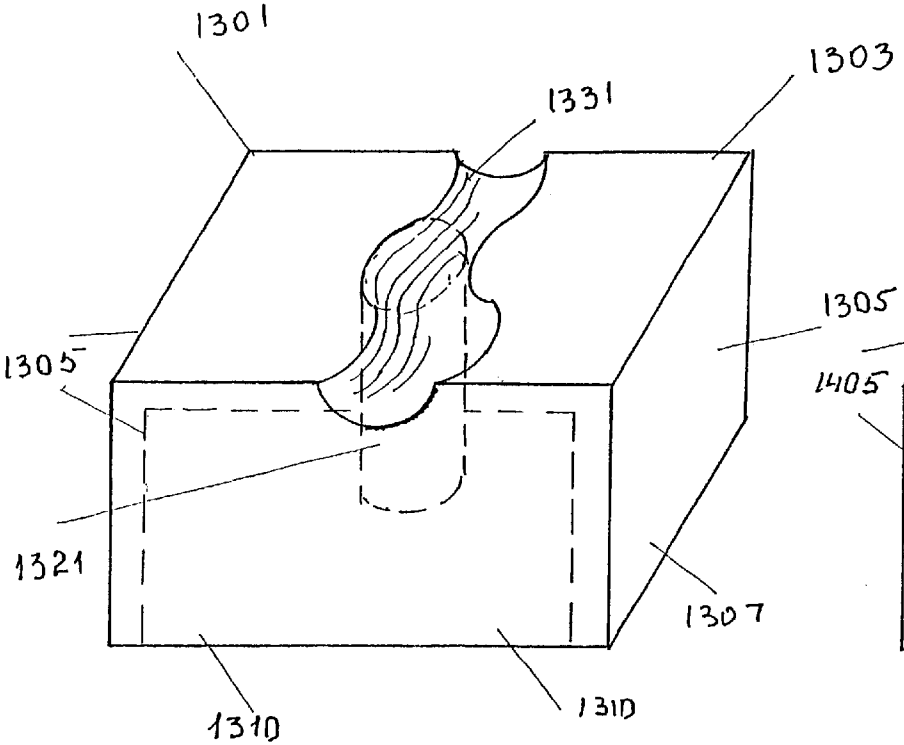
FIG. 28 is perspective view of a toy construction block with an S-shaped groove.
Figure 31:
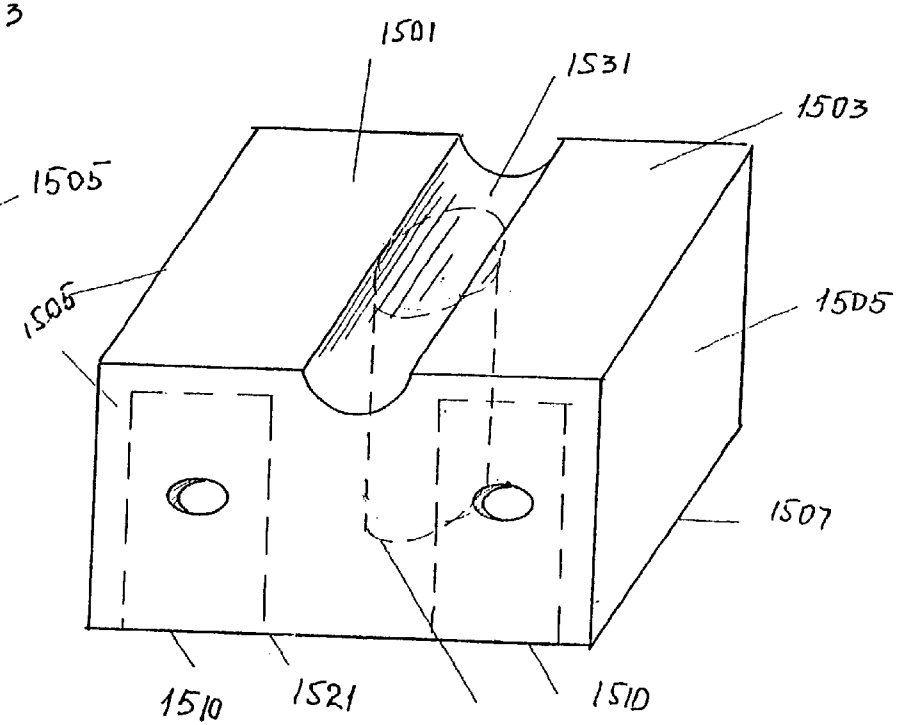
FIGS. 30, 31 and 32 are two perspective views and a side view, respectively, of a grooved toy construction block with male and female connector pegs for attachment of adjacent grooved toy construction blocks.
Figure 30:
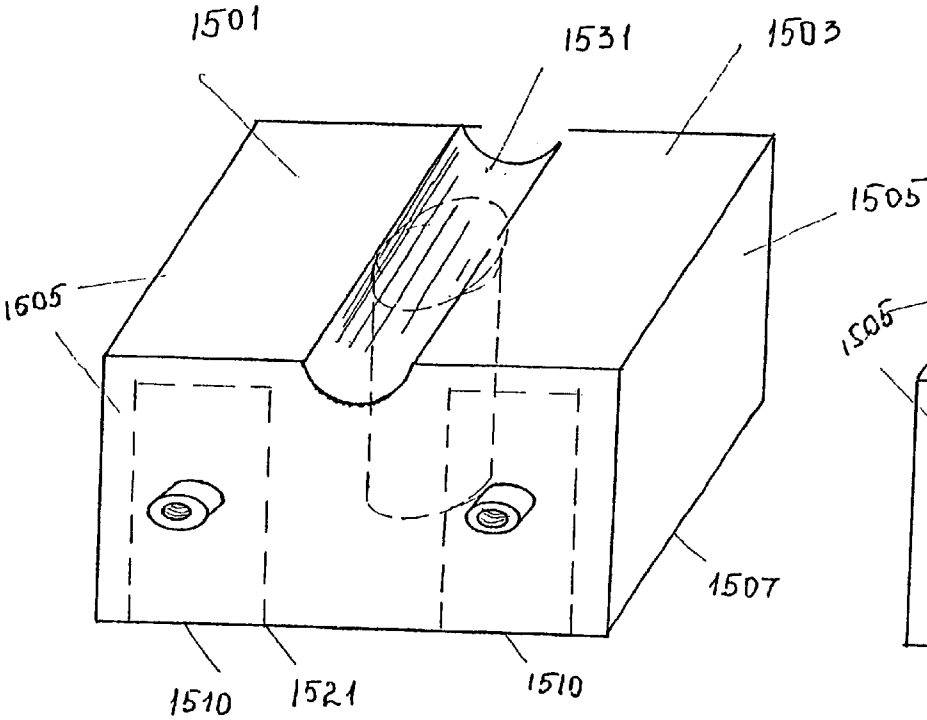
Figure 33:
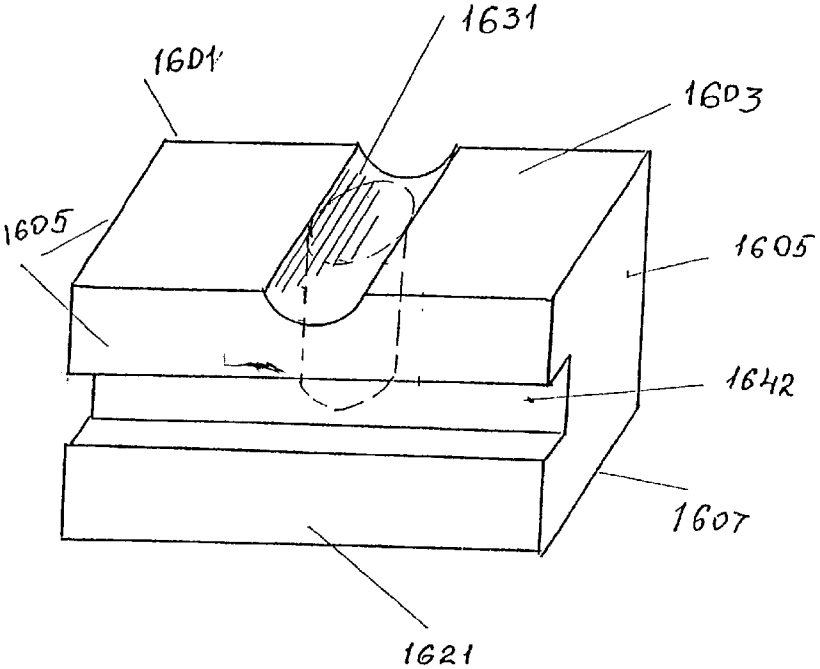
FIGS. 33, 34 and 35 are two perspective views and a side view, respectively, of a grooved toy construction block with a hook and a slot for attachment of adjacent grooved toy construction blocks.
Figure 32:
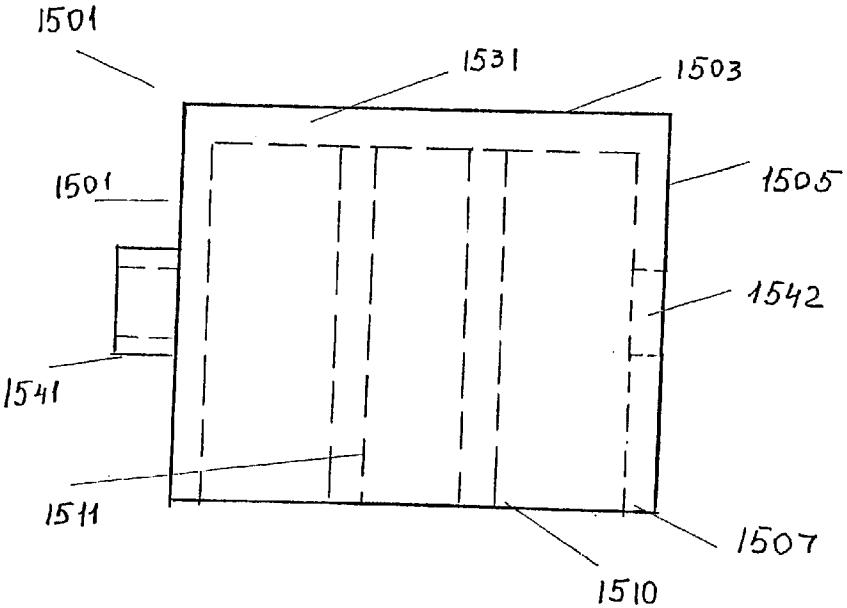
Figure 34:
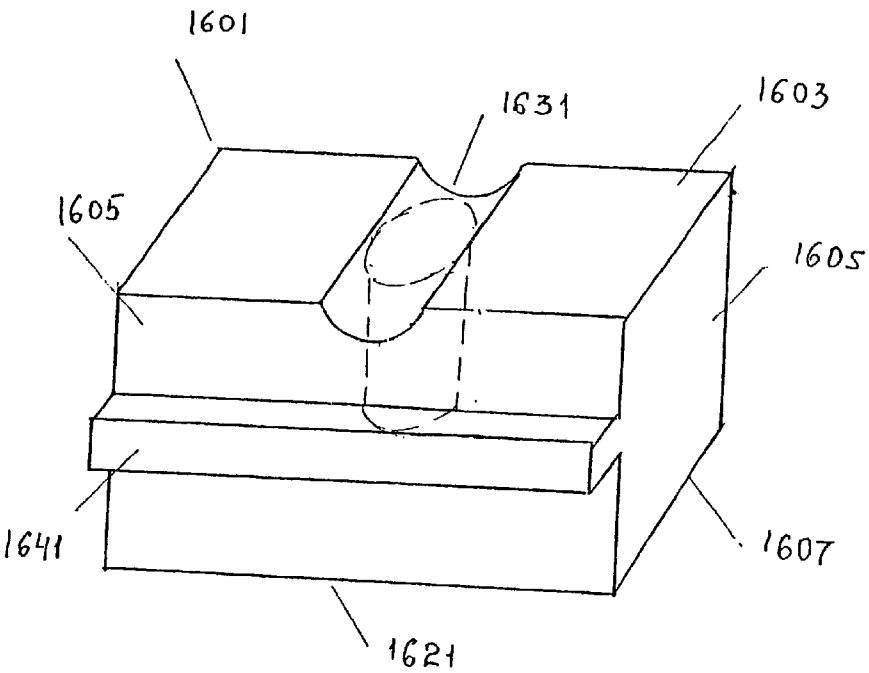
Figure 35:
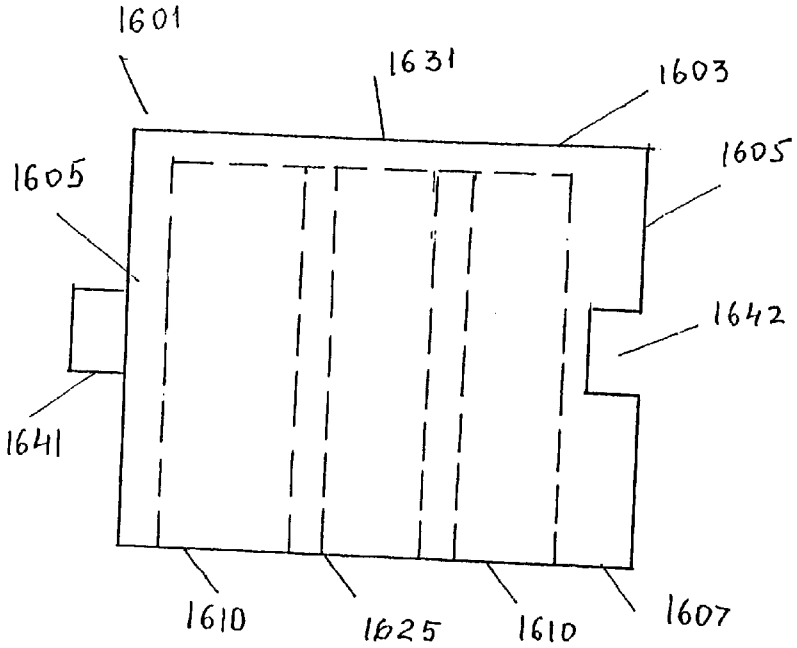
Figure 37:
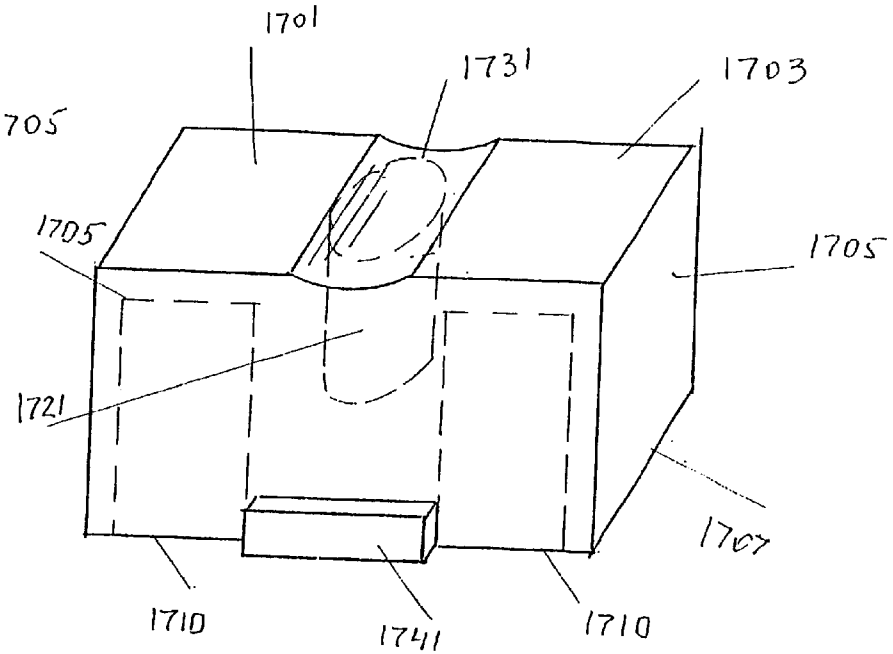
FIGS. 36, 37 and 38 are two perspective views and a side view, respectively, of a grooved toy construction block with a recess and a tongue for attachment of adjacent grooved toy construction blocks.
Figure 36:
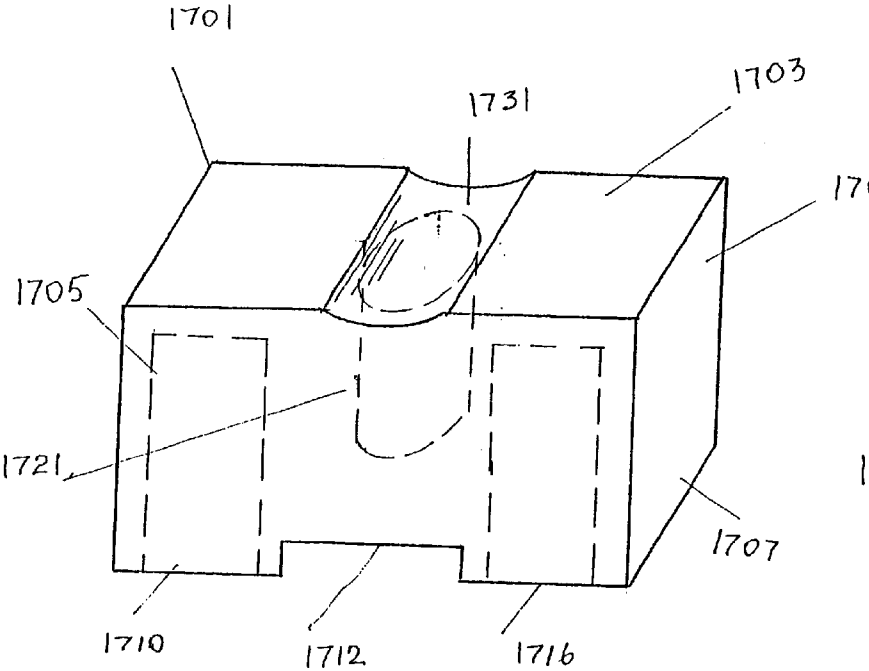
Figure 38:
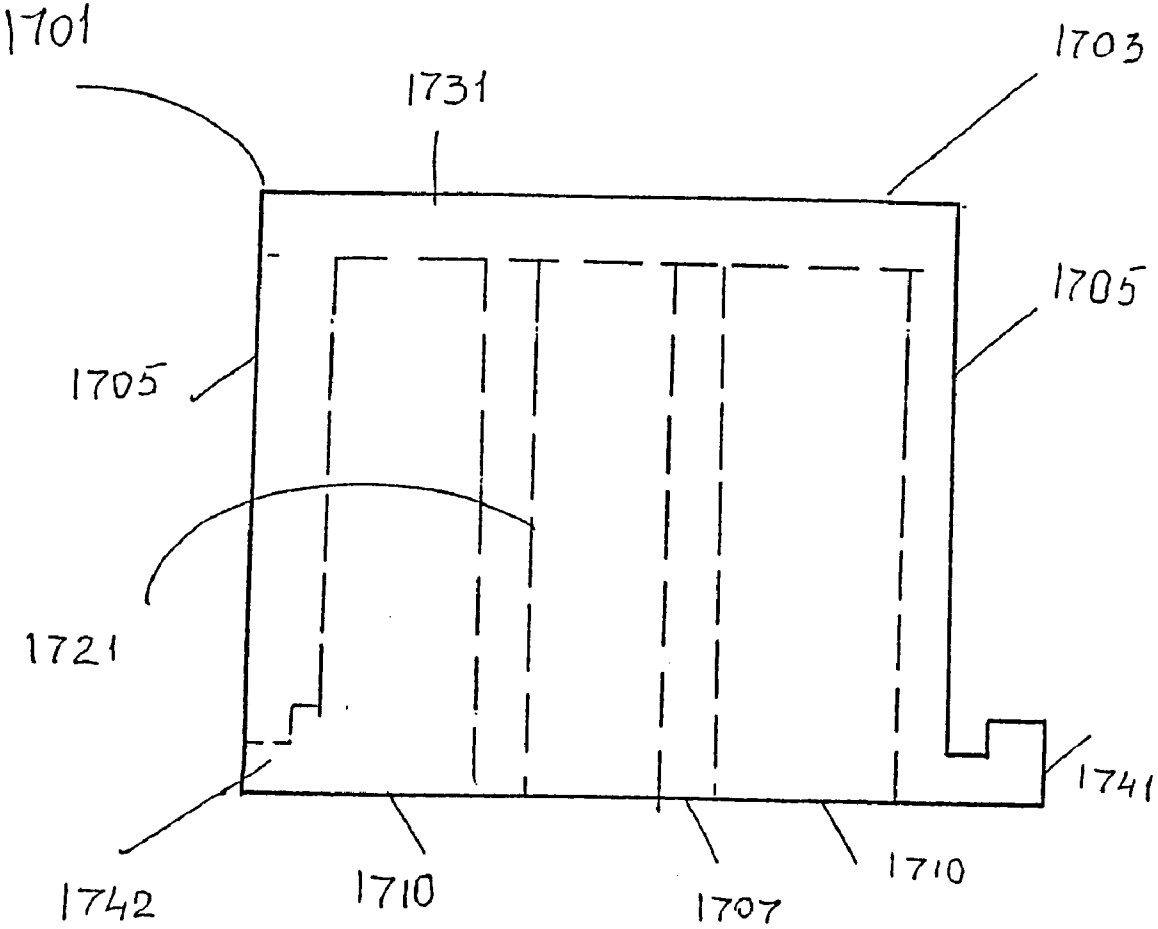
Figure 40:
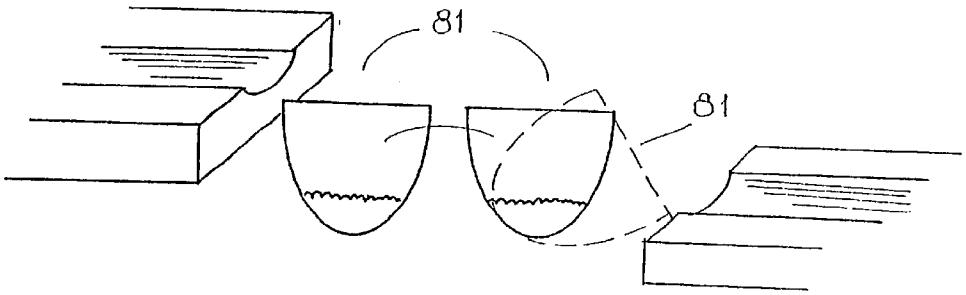
FIGS. 39 and 40 show a tilt cup device for integration with a waterslide toy block construction system.
Figure 42:
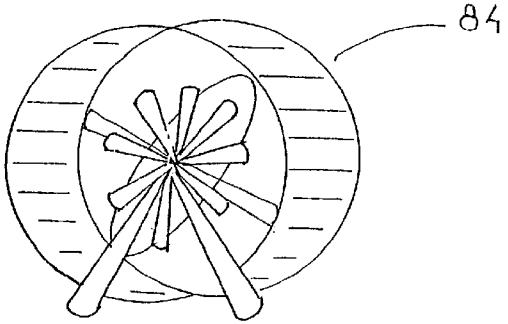
FIGS. 41 and 42 show miniature water-propelled ferris wheels for integration with a waterslide toy block construction system.
Figure 39:
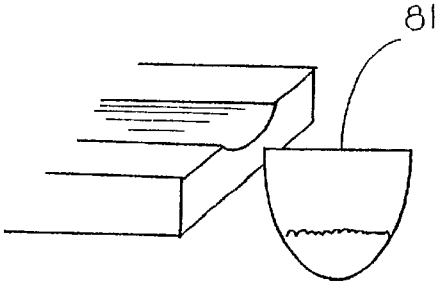
Figure 41:
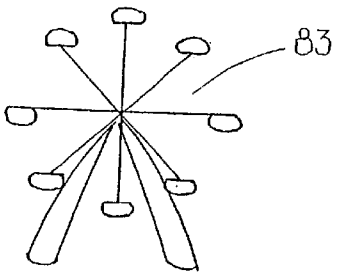
Figure 43:
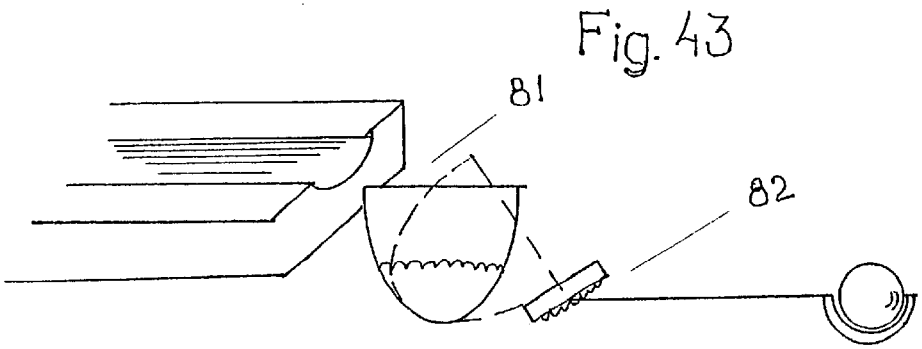
FIG. 43 is a tilt cup and spring-activated catapult device for integration with a waterslide toy block construction system.
Figure 44:
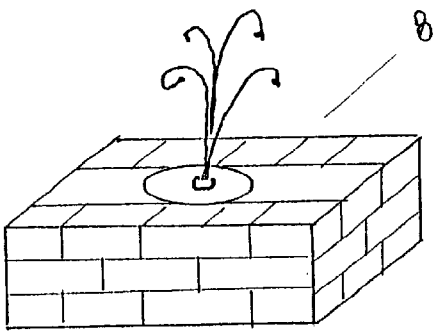
FIG. 44 is a toy block sprinkler unit for integration with a waterslide toy block construction system.

Referring now to FIGS. 9, 10 and 11, a typical grooved toy construction block 301 has a conduit for water 331 (hereinafter "groove"). This block is similar in construction to the standard toy construction block of FIGS. 3, 4 and 5, having a top surface 303, a bottom surface 307, and at least four side surfaces 305, as well as an elongated friction post 321 extending from undersurface 112.

A waterslide toy block construction system 1 can also be used with a variety of grooved toy construction blocks as shown in FIGS. 12 through 29. These blocks may be selected to vary the path of flowing water in a fashion determined by the user. FIGS. 18 through 23, in particular, show grooved toy construction blocks that also have a plurality of elongated projections extending from the top surface of each such construction block. Such blocks can be arranged with other blocks or with miniature toy figures to vary both the appearance of the system and the route that water flowing within the system will take. Referring to FIGS. 30 through 38, the plurality of grooved toy construction blocks in a waterslide toy block construction system 1 also includes such blocks having attachment means for connection of adjacent grooved toy construction blocks. Such attachment means can comprise male connectors 1541 and female connectors 1542 (FIGS. 30 and 31), a hook 1641 and a corresponding slot 1642 (FIGS. 33 and 34), or a tongue 1741 and recess 1742.

Figure 45:
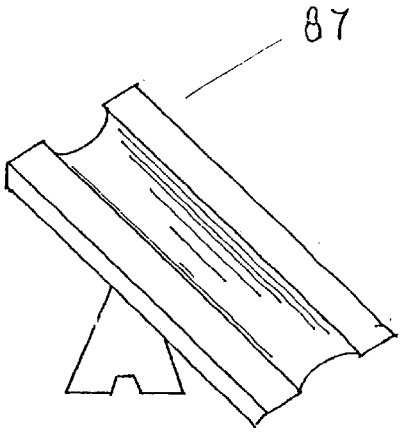
FIG. 45 is a miniature grooved see-saw for integration with a waterslide toy block construction system.
Figure 46:
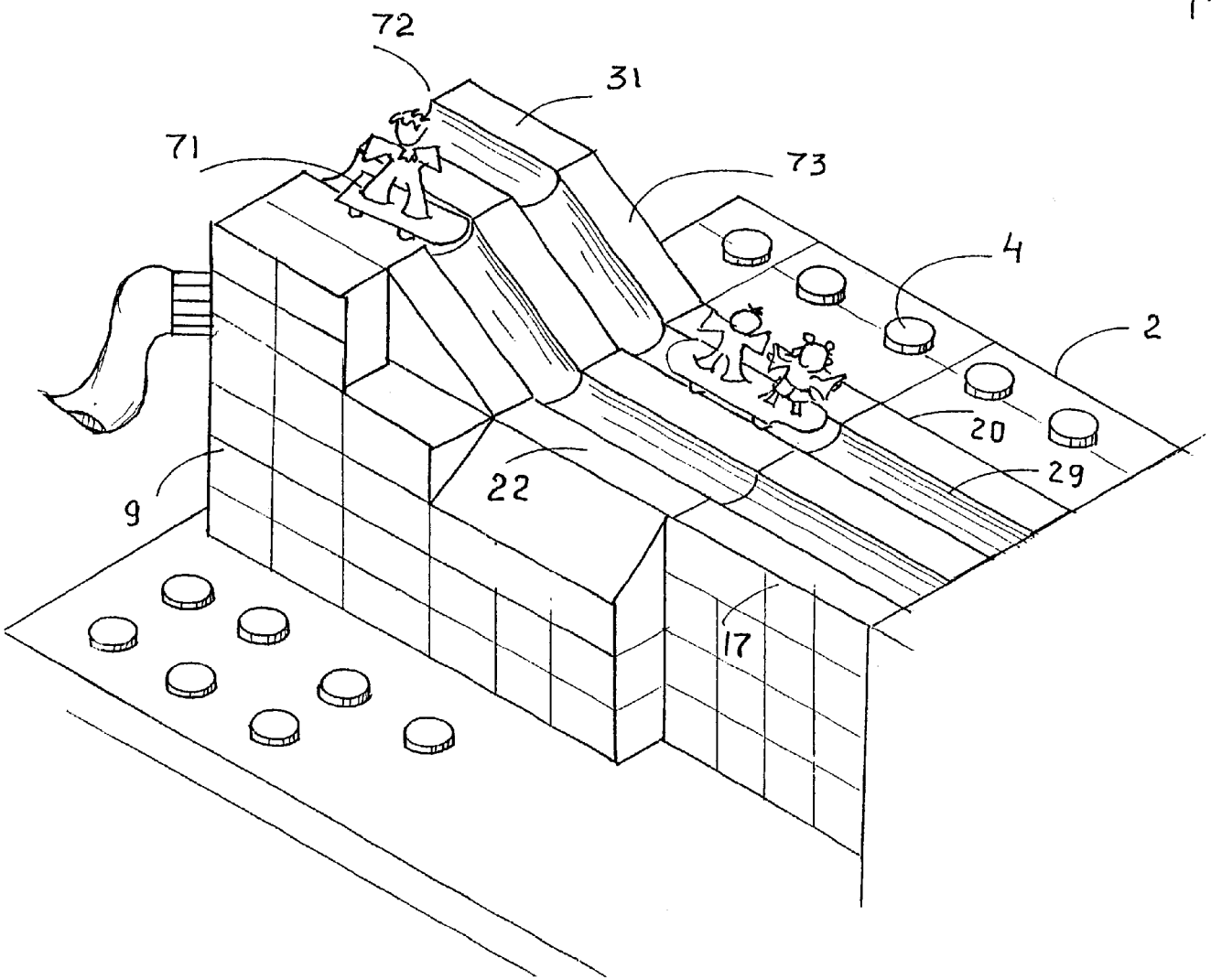
FIG. 46 is a partial perspective view of a waterslide toy block construction system with an attachment unit for connection to a water source, said water source comprising a garden hose.
Figure 47:
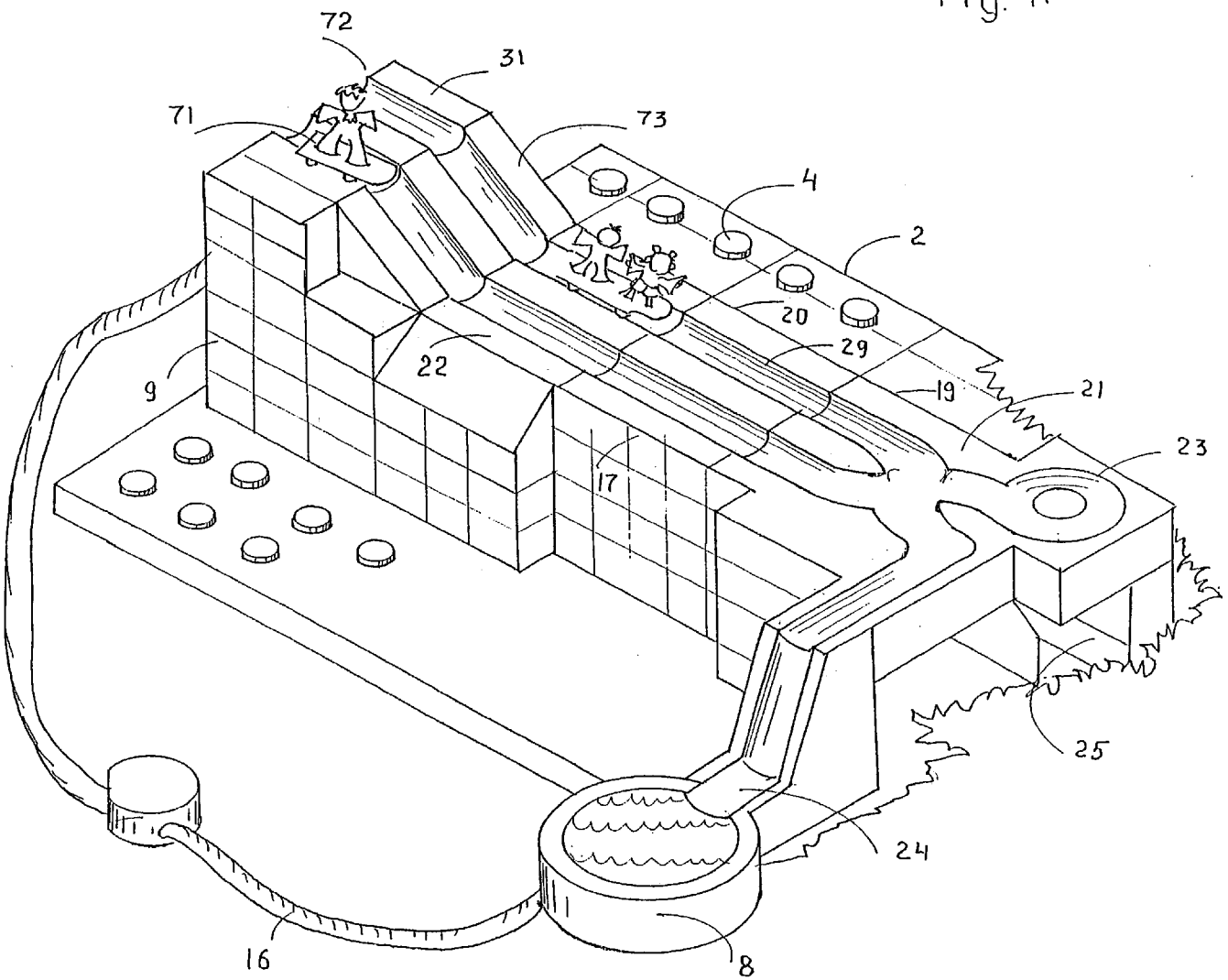
FIG. 47 is a perspective view of a waterslide toy block construction system with an attachment unit for connection to a water source, said water source comprising a water storage reservoir and a pumping means for recycling water throughout the multi-block structure.

Referring now to FIGS. 39 through 45, a waterslide toy block construction system 1 can integrate various miniature toy amusements which are activated by flowing water. Such amusements include, but are not limited to, the following: a tilt cup device 81 (FIGS. 39 and 40); a water-propelled wheel 83 and paddle-propelled ferris wheel 84 (FIGS. 41 and 42); a tilt cup device 81 with spring activated catapult 82 (FIG. 43); a toy block sprinkler unit 85 (FIG. 44); and a grooved seesaw 87 (FIG. 45). Referring now to FIG. 46, an alternative embodiment of a waterslide toy block construction system has a water source comprising a garden hose 11 connected to attachment 7 of multi-block structure 9. Another alternative embodiment of a waterslide toy block construction system as shown in FIG. 47 can have a water source comprising a water storage reservoir 8 connected to pumping means 6 by water return avenue 16. Pumping means 6 is further connected to attachment 7 of multi-block structure 9 by water return avenue 10 for recirculation of water throughout the system.

Figure 48:
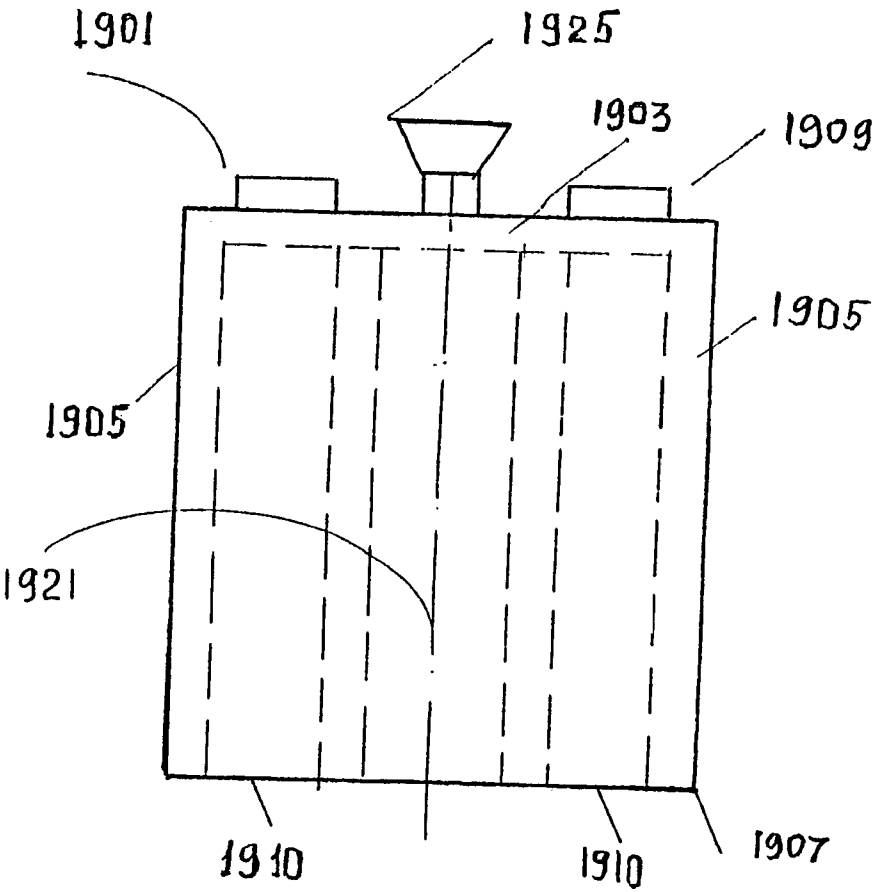
FIG. 48 is a side view of a standard construction block having an electrical power source.

Referring now to FIG. 48, there is shown a side view of a standard construction block having an electrical power source. Similar parts as to those shown in FIG. 3, are similarly numbered but beginning with "1900". It includes and electrical power source 1925, which, in this case is a solar panel.

Obviously, numerous modifications and variations of the present invention are possible in light of the above teachings. It is therefore understood that within the scope of the appended claims, the invention may be practiced otherwise than as specifically described herein.

What is claimed is:

1. A waterslide toy block construction system, which comprises:

(a) a plurality of standard toy construction blocks, said construction blocks manufactured for erection and disassembly by a user; each of said standard toy construction blocks having a top, four sidewalls and an open bottom, said open bottom exposing an undersurface of said top; each of said standard toy construction blocks having a plurality of elongated projections extending from said top surface; each of said standard toy construction blocks also having at least one elongated friction post thereon, said friction post being hollow and extending from said underside of said top;

(b) a plurality of ramp blocks, each of said ramp blocks having a top that slopes considerably from the horizontal, at least three sidewalls and an open bottom, said open bottom exposing an undersurface of said top; each of said ramp blocks also having at least one elongated friction post thereon, said friction post being hollow and extending form said underside of said top;

(c) a plurality of grooved toy construction blocks, said construction blocks manufactured for erection and disassembly by a user to create extended and generally horizontal or vertical paths for flowing water; each of said grooved toy construction blocks having a top, four sidewalls and an open bottom, said open bottom exposing an undersurface of said top; each of said grooved toy construction blocks having at least one elongated friction post thereon, said friction post being hollow and extending from said underside of said top; each of said grooved toy construction blocks having at least one groove defined on said top and within said sides; each of said grooved toy construction blocks having attachment means for securement with adjacent grooved toy construction blocks;

(d) attachment means for securement of said grooved toy construction blocks wherein said attachment means comprise a first fastening element defined by a side surface of a first grooved toy construction block and a collaborating second fastening element defined by an adjacent side surface of an adjacent grooved toy construction block, said first and second fastening elements adapted to interconnect said construction blocks so as to sustain a flow of water thereon, and resist separation of said grooved toy construction blocks;

(e) at least one construction block unit with water inlet having attachment to a water source;

(f) means to reduce water pressure and prevent detachment of said water source due to hydrodynamic motion therethrough; and (g) a plurality of toy miniatures each having an undersurface that defines a plurality of apertures, said apertures sized, shaped and spaced so as to receive elongated projections of a standard toy construction block.

2. The waterslide toy block construction system of claim 1 wherein at least one of said standard toy construction blocks, ramp blocks and grooved toy construction blocks is connected to other of said standard toy construction blocks, ramp blocks, and grooved toy construction blocks to form at least one multi-block structure, said structure having at least one pre-shaped grooved path thereon, said path being defined by adjacent grooved toy construction blocks and capable of conveying flowing water thereon.

3. The waterslide toy block construction system of claim 2 wherein a base is included for connecting said standard toy construction blocks, ramp blocks, and grooved toy construction blocks, said base comprising a top and a bottom, said top having a plurality of elongated projections extending therefrom for interlocking with said standard toy construction blocks, ramp blocks and grooved toy construction blocks.

4. The waterslide toy block construction system of claim 1 wherein at least one of said standard toy construction blocks has no elongated protrusions thereon.

5. The waterslide toy block construction system of claim 1 wherein said plurality of grooved toy construction blocks includes a plurality of grooved toy construction blocks having a plurality of elongated projections, said plurality of elongated projections extending from said top surface of each of said grooved toy construction blocks.

6. The waterslide toy block construction system of claim 1 wherein said plurality of grooved toy construction blocks includes a plurality of grooved ramp blocks, each of said grooved ramp blocks having a top that slopes considerably from the horizontal, each of said grooved ramp blocks having at least one groove defined on said top and within said sides for travel of water thereon.

7. The waterslide toy block construction system of claim 1 wherein said plurality of grooved toy construction blocks includes a plurality of grooved wedge blocks, each of said grooved wedge blocks having at least one of said sidewalls that slopes considerably from the vertical; each of said grooved wedge blocks having at least one groove defined on one of said sidewalls for travel of water thereon.

8. The waterslide toy block construction system of claim 7 wherein said plurality of grooved wedge blocks includes a plurality of grooved wedge blocks having a plurality of elongated projections, said plurality of elongated projections extending from said top surface of each of said grooved wedge blocks.

9. The waterslide toy block construction system of claim 1 wherein at least one of said grooved toy construction blocks, grooved ramp blocks and grooved wedge blocks has a top and one of said sidewalls jointly defining a first groove for travel of water thereon, and said top and one of said sidewalls jointly defining a second groove for travel of water thereon.

10. The waterslide toy block construction system of claim 9 wherein said first groove and said second groove intersect.

11. The waterslide toy block construction system of claim 1 wherein at lest one said grooved toy construction block defines an opening in connection with said groove and extending from said top surface, said opening sized for water to flow within said groove and through said opening.

12. The waterslide toy block construction system of claim 1 wherein said water source comprises a garden hose.

13. The waterslide toy block construction system of claim 1 wherein said water source comprises at least one water storage reservoir, said water storage reservoir having at least one orifice formed thereon for the addition and subtraction of water therefrom; a plurality of water return avenues connecting said miniature water amusements to said water storage reservoir; and pumping means connected to said water storage reservoir for circulating water from said water return avenues to said water storage reservoir.

14. The waterslide toy block construction system of claim 1 wherein said attachment means comprise at least one male connector peg extending from said side surface of one construction block and at least one female connector peg recessed in said side surface of an adjacent construction block, said interlocking pegs sized and shaped so as to frictionally engage one another to prevent separation of said construction blocks.

15. The waterslide toy block construction system of claim 1 wherein said attachment means comprise a slot defined by a lip extending from said side surface of one construction block and a hook defined by a lip extending from said side surface of an adjacent construction block, said slot and said hook sized and shaped so as to slide said hook into said slot, interengaging said lips so as to prevent separation of said construction blocks.

16. The waterslide toy block construction system of claim 1 wherein said attachment means comprise a recess in said side surface of one construction block, said recess sized and shaped so as to receive a similarly shaped tongue extending from said side surface of an adjacent construction block, said tongue inserted into such recess so as to interengage said tongue and said recess so as to prevent separation of said construction blocks.

17. The waterslide toy block construction system of claim 1 wherein said plurality of construction blocks includes housing of an electrical power source.

18. The waterslide toy block construction system of claim 17 wherein said electrical power source comprises a solar panel arranged upon a surface of said housing of said electrical power source.

* * * * *